US005204657A

United States Patent [19]

Prosser et al.

[11] Patent Number: 5,204,657

[45] Date of Patent: Apr. 20, 1993

[54] LOCATING DEVICE

[75] Inventors: Robert L. Prosser, Carlsbad; Stephen P. Sacarisen, La Jolla, both of Calif.

[73] Assignee: Impact Products Corporation, San Juan Capistrano, Calif.

[21] Appl. No.: 706,152

[22] Filed: May 28, 1991

[51] Int. Cl.[5] ..... G08B 13/14

[52] U.S. Cl. ..... 340/568; 340/825.49

[58] Field of Search ..... 340/568, 571-573, 340/539, 311.1, 505, 825.54, 323 R, 825.49, 825.34; 341/176; 455/66-67; 235/385; 40/634, 300

[56] References Cited

U.S. PATENT DOCUMENTS

| | | | |
|---|---|---|---|
| 4,101,873 | 7/1978 | Anderson et al. | 340/539 |
| 4,507,653 | 3/1985 | Bayer | 340/539 |
| 4,673,932 | 6/1987 | Ekchian et al. | 340/825.54 |
| 4,845,492 | 7/1989 | Cobb et al. | 340/825.49 |
| 4,961,575 | 10/1990 | Perry | 340/825.49 X |

FOREIGN PATENT DOCUMENTS

| | | | |
|---|---|---|---|
| 2455259 | 5/1976 | Fed. Rep. of Germany | 340/825.49 |
| 3515445 | 10/1986 | Fed. Rep. of Germany | 340/568 |
| 0314994 | 12/1988 | Japan | 340/825.49 |
| 0171396 | 7/1989 | Japan | 340/825.49 |

*Primary Examiner*—Jin F. Ng
*Assistant Examiner*—Thomas J. Mullen, Jr.
*Attorney, Agent, or Firm*—David L. Baker

[57] ABSTRACT

A locating device has a locating circuit having a oscillator/counter logic circuit, a reset circuit, a reset beep circuit, an enable flip-flop, a delay flip-flop, a mux (multiplexer) flip-flop a mux logic circuit and a piezo oscillator circuit. The locating device is generally designed to assist the user to locate an object of which the locating device is a part. The preferred embodiment of the device is especially useful to determine the location of a misplaced television remote control. The alternative embodiment of the device could also be used to locate an object such as a credit card, locate an animal when lost or to find person on which the device is carried as a game. The locating device may also be used to reduce the occurrences of misplacement of objects or items (credit cards, ID cards, etc.) from their proper place or to alert a person when the object or item is in an improper place. The alternative embodiment has mode switch to control the audio alarm emission cycle.

6 Claims, 4 Drawing Sheets

LOCATING DEVICE

BACKGROUND OF THE INVENTION

1. Field of the Invention

The locating device is generally designed to assist the user to locate an object of which the locating device is a part. The device could also be used to locate an object, animal or person on which the device is carried. The device is especially useful to determine the location of a misplaced appliance or entertainment (for example a television) remote control unit. When the device is attached to a remote control unit and that unit has been misplaced, the circuitry will emit audio beep signals to give audio homing clues that aid in locating the remote control unit.The device may be applied to existing remote controls or placed in new remote controls when they are manufactured. The locating device may also be used to reduce the occurrences of misplacement of objects or items (credit cards, ID cards, etc.) from their proper place or to alert a person when the object or item is in an improper place.

It is also useful in itself as an integral part of a game in which the device is hidden by a player and sought by a fellow player. In this alternative embodiment, the locator device is attached to an object or person to be found by one or more players of a "hide and seek" game. The challenge of the game is heightened by the ability to change the time duration between the beeps. Other uses can be anticipated as variations of the above two examples.

2. Description of the Related Art

Previous devices such as car or house key locators have been offered to the public but are simple switch-on switch-off units which do not offer the sophistication nor the variation of the present location device. Another methods of location use two-way radio communication and infrared devices. Most of which are bulky, easy to damage and expensive.

SUMMARY OF THE INVENTION

The preferred embodiment of the locating device is an electronic device that helps alleviate a problem that has plagued appliance or entertainment device users since wireless remote controls came in use. "Where is the remote control unit?" The locating device when used in conjunction with, for example, a TV remote control not only assists the users of the remote control to find it, it motivates the guilty party to place the remote control where it belongs by announcing the users neglect in a series of accusing beeps. Research has shown the television set in an American household is on an average of 53.75 hours per week. Considering how often people switch channels in that time, the need for a device to locate misplaced remote controls is great.

The locating device differs from conventional transmitter-receiver technology in that a radio receiver requires that the device be always in a power-up mode. Because of this the circuit design results in a shortened battery life. The present circuitry allows the device to power-down except when the circuit is powered-on by activating a switch. This power-on is automatic under certain conditions that occur when the remote control has been misplaced. This allows the locating device to utilize smaller (such as micro) batteries and have them last for a longer time. The preferred embodiment may have a base made of a conductive material and when the locating device circuitry is placed on the base, contact closes a switch and powers down the unit to save battery life.

The preferred embodiment generates three sequential stages of audio beep signals. The first stage is a programmed delay time that inhibits the beep signal sequence to allow the remote control to be used and placed back on its conductive base before fully activating its alert signals. The base closes a switch in the locating device's circuitry that prevents the generation of the audio beep signals. The time delay may be adjustable and set by a user to a predetermined time during which most remote units are used before being set down. The second stage generates a programmed repetitive beep signal sequence to indicate that the remote unit has not been returned to its base and may become misplaced or lost. The third stage begins after a fixed number of beeps generated by the second stage have elapsed. The beep signals of the third sequence may be pre-programmed by the user at a slower rate that the stage two beep signals. This slower beep signal sequence reduces power consumption but still provides an audio homing signal to aid in the recovery of the remote unit. The locating device utilizes SMT or Hybrid assembly technologies to allow the manufacture of a product that is incredibly thin, rugged and small in size.

Using micro-electronic circuitry and state-of-the-art battery technology, the locator device could be adapted to reducing the loss of informational media storage card such as credit cards, identification cards and other valuable objects by alerting the owner of his or her forgetfulness or by identifying a person in whose possession the card or object should not be. The reset switch that activates the locator circuit technology could be an optical, magnetic or capacitive sensor. This would be especially useful in the above mentioned wallet/credit card embodiment. The first stage delay could be deleted in an alternate design. The wallet would be configured as a conductive (such as capacitive or resistive) base similar in its function to the function of the base mentioned in the preferred embodiment.

In an alternative embodiment, the locating device, after being reset, will also generate three sequential stages of audio beep signals. However, there are difference between the preferred embodiment and the alternative embodiment.In the alternative embodiment, the first stage has a programmed time delay that inhibits the beep signal from being activated in order to allow the object or person to which it is attached to be hidden or to hide. The second stage generates a programmed repetitive beep sequence that the object or person is hidden and the search should begin. These stage two beeps have a long interval between beeps to make the search more difficult. If the device is not found after a certain number of stage two beeps, the device enters into the third stage sequence wherein the beeps become more rapid. In the preferred embodiment, the second stage beep sequence is rapid and the third stage beep sequence is slower. In the alternative embodiment, the second stage beep sequence is slow and the third stage beep sequence is rapid. The alternative embodiment may also have a mode switch that allows the user to switch from a fast (normal) repetitive beep cycle to a slow (difficult to locate) repetitive beep cycle. This allows the players to increase the difficulty of locating the object as players become more adept at the game.

The preferred embodiment of the locator device contains a locating circuit that consists of several logic blocks. Each of these blocks perform a separate function that assist in implementing the purpose of the locating device.

The oscillator /counter circuit logic block generates a master clock time base. This counter circuit provides all the repetitive timing and delay signals used by the other logic blocks. All the counters are cleared to zero by the RESET signal. The counter circuit's sequential ripple count will start only when the RESET signal is inactive. The RESET signal is generated by a switch circuit block containing a touch switch and a logic gate.

The reset beep circuit logic block generates a single pulse PRESET signal once the RESET signal has gone inactive. The delay flip-flop circuit logic block controls the first stage delay time feature and is reset by the RESET signal and is set once by the CLK2 delay signal. The output of the delay circuit is the signal, DATA, which inhibits the enable flip-flop circuit logic block and the mux (multiplexer) flip-flop circuit logic block from being set. The output of the enable flip-flop circuit logic block is the signal, ENABLE, which gates the piezo oscillator circuit logic block on or off.

The piezo oscillator circuit activates the beep alarm. The enable flip-flop circuit is cleared by the RESET signal and during counting it is continuously cleared by the CLEAR signal generated by the oscillator/counter circuit. The output signals of the mux flip-flop circuit logic block are Q and QB which control the mux trigger circuit logic block. The mux trigger circuit will multiplex either the CLK1 (CLOCK1) or the CLK0 clock signal to allow the mux trigger circuit to output the TRIGGER signal. The mux flip-flop circuit outputs the QB signal when it receives the RESET signal. At this point, the mux flip-flop instructs the mux trigger circuit to allow the CLK1 signal to control the TRIGGER signal output to the enable flip-flop circuit. The mux flip-flop continues in this mode and is inhibited from changing until the delay flip-flop circuit has been set. After the delay flip-flop circuit has been set, the delay flip-flop circuit's output signal, DATA, enables the mux flip-flop circuit to change state and send the CLK0 signal to the mux trigger circuit to control the TRIGGER signal output.

The alternative embodiment has certain modifications to the circuit of the preferred embodiment. In this embodiment, the delay flip-flop is reset by the RESET signal and is set by the selected CLK2 signal. The CLK2 signal chosen is selected by a mode switch which determines the delay used and the repetitive beep cycle of the audio beep output. This alternative circuit path is shown in FIG. 4 in an insert figure near the circuit for the preferred embodiment and shown connected with SW2 (switch 2). The capacitive-activated switch circuit of the reset circuit is shown as an insert near the resistance-activated switch circuit of the preferred embodiment.

A locating device is presented that has a locating circuit comprising a oscillator/counter logic circuit, a reset circuit, a reset beep circuit, an enable flip-flop, a delay flip-flop, a mux (multiplexer) flip-flop and a mux logic circuit and a piezo oscillator circuit.

The oscillator/counter logic circuit has a plurality of counter flip-flops to generate a first clock delay signal (CLK0), a second clock delay signal (CLK1), a third clock delay signal (CLK2) and a clear signal (CLEAR). The reset circuit generates a reset signal (RESET) to clear the state of the counter flip-flops, in the oscillator/counter logic circuit, to zero and generate a reset* signal (RESET*) to clear the reset beep circuit, the enable flip-flop, the delay flip-flop, and the mux flip-flop. The reset beep circuit supplies a single pulse, preset signal (PRESET) to the enable flip-flop, the enable flip-flop generating an enable signal (ENABLE) that triggers the piezo oscillator circuit to drive a piezo alarm element in the piezo oscillator circuit. The clear signal resets the enable flip-flop to control the duration the piezo alarm element is activated, and is driven by the oscillator/counter logic circuit. The delay flip-flop, cleared by the reset* signal and set high by the third clock delay signal, supplies a data signal (DATA) that inhibits the enable flip-flop from being set and enables the mux flip-flop to be set by the next cycle of the third clock delay signal.

The mux flip-flop then sends a mux state signal to the mux logic circuit. The mux state signal controls the state of the mux logic circuit to multiplex the first clock delay signal or the second clock delay signal that generates a trigger signal (TRIGGER). The enable flip-flop triggered by the trigger signal sets the enable flip-flop setting the enable signal that sets the duration of the activation of the piezo alarm element. The piezo oscillator circuit, activated by the enable signal, activates the piezo alarm element to emit an audio alarm signal.

The reset circuit may have a resistance-activated switch and a reset logic gate. The reset circuit may also have a mode switch to select a delay time interval for the third clock delay signal (CLK2). In the alternative embodiment, there is a capacitive-activated switch circuit and switch instead of the resistance-activated switch and circuit of the preferred embodiment.

In a timing analysis (see FIG. 5, preferred embodiment/FIG. 6, alternative embodiment, which has a CLK0), a piezo alarm oscillator signal OSC runs continuously (as does a counter time base signal CLK), which in the actual circuits will be gated on or off by the ENABLE signal. A gated output piezo alarm oscillator signal BEEPER stimulates the actual audio beep output signal. A RESET* signal goes high and the CLK0 (alternative), CLK1 and CLK2 output signals begin counting an input CLK signal. The rising and falling edges of Q9 (IC1) signal generates the signal one-shot pulse signal PRESET*. PRESET* presets the enable FF to generate a single pulse ENABLE signal that gates the piezo oscillator circuit to output a single BEEPER signal. The enable FF's output signal ENABLE is continuously cleared after being set by the CLEAR signal. The CLK2 signal is the counter signal that will cause a delay before the stage two repetitive beep sequences. The first rising edge of the CLK2 signal sets the delay FF and the delay FF's DATA signal is set high. The DATA signal enables the enable FF to be set when clocked by the rising edges of the TRIGGER signal. The DATA signal also enables the next rising edge of CLK2 to clock the mux FF changing the state of a MUX STATE signal from low to high. When the MUX STATE signal is low, the mux logic will multiplex the CLK1 signal to the TRIGGER signal. Each rising edge of the TRIGGER signal, when DATA is high, will clock the enable FF. When the MUX STATE signal is high, the mux logic gates multiplex the CLK2 (CLK2=CLK0 in the preferred embodiment) signal to the TRIGGER signal which in turn clocks the enable FF. The locator circuitry in both the preferred and the alternative embodiment (as discussed on page 4 will count through the three sequential state phases and will stay in the state three beep sequence until the RESET* signal is active.

The mode switch SW2, used in the alternative embodiment (see FIG. 6), is able to change the CLK2 signal to use Q2 or Q3 (IC2).

A portable base having a conductive circuit to close the resistance-activated switch of a locating device placed on an informational media storage card or similar device. The base could be made of a conductive material or have one or more conductive strips within the base. The base could be a wallet especially constructed to house the protected cards having the locating device circuit thereon.

It is an object of this invention to provide a locating device that will enable a user to locate an object and especially a television remote control, upon which it has been attached, to locate that object when it has been misplaced.

It is another object of this invention to provide a locating device that will act as a game the object of which is to allow the users to compete to see who can locate the device the fastest.

DESCRIPTION OF THE PREFERRED EMBODIMENT

Figure 1:
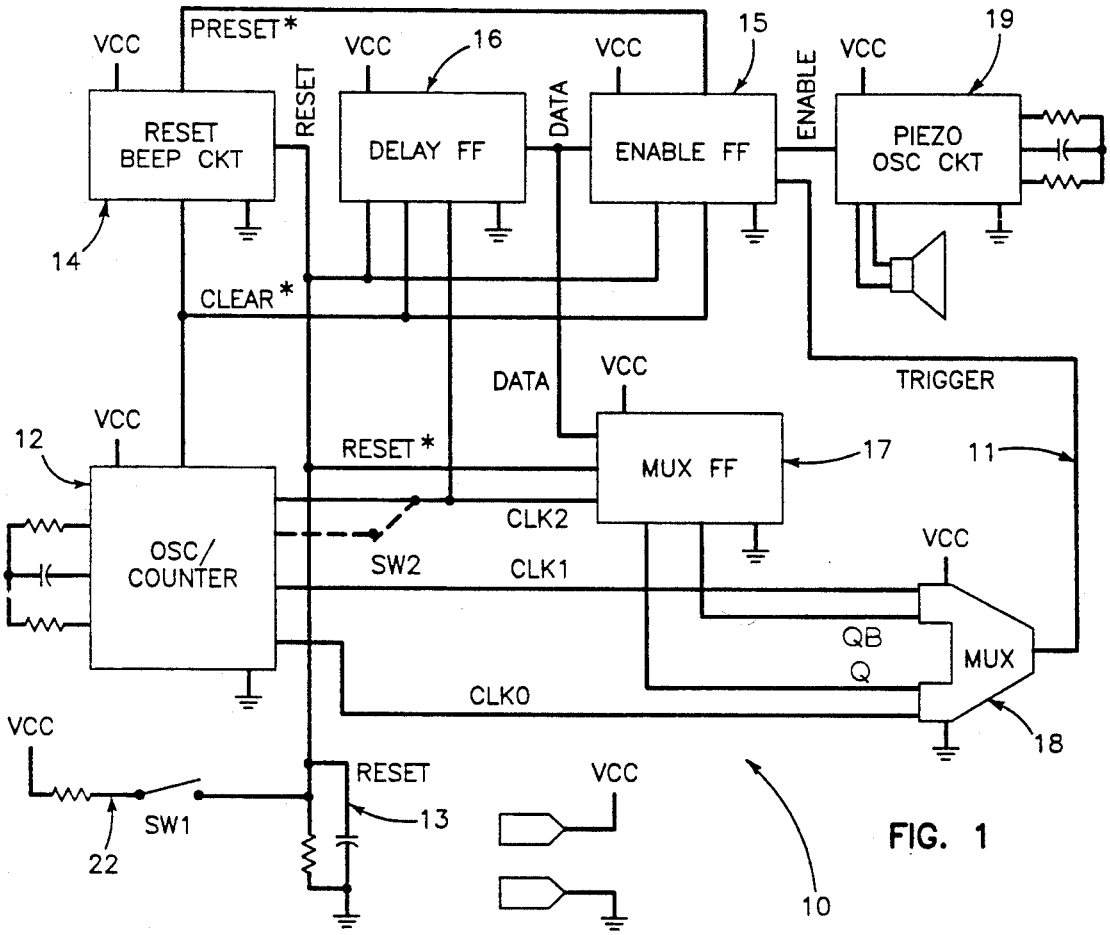
FIG. 1 is a block diagram showing the locating circuit of the locating device.

A locating device 10 is shown in FIGS. 1 through 4. The locating device 10 has a locating circuit 11 comprising an oscillator/counter logic circuit 12, a reset circuit 13, a reset beep circuit 14, an enable flip-flop 15, a delay flip-flop 16, a mux (multiplexer) flip-flop 17 and a mux logic circuit 18 and a piezo oscillator circuit 19.

The oscillator/counter logic circuit 12 has a plurality of counter flip-flops 20 that generate a first clock delay signal CLK0, a second clock delay signal CLK1, a third clock delay signal CLK2 and a clear signal CLEAR*.

The reset circuit generates a reset signal RESET to clear the state of the counter flip-flops 20 in the oscillator/counter logic circuit 12, to zero and generate a RESET* signal to clear the reset beep circuit 14, the enable flip-flop 15, the delay flip-flop 16, and the mux flip-flop 17.

The reset beep circuit 14 supplies a single pulse, preset signal PRESET* to the enable flip-flop 15. The enable flip-flop 15 generates an enable signal ENABLE that triggers the piezo oscillator circuit 19 to drive a piezo alarm element 21 in the piezo oscillator circuit 19.

The clear signal CLEAR* resets the enable flip-flop 15 to control the duration the piezo alarm element 21 is activated, is driven by the oscillator/counter logic circuit 12.

The delay flip-flop 16, cleared by the RESET* signal and set high by the third clock delay signal CLK2, supplies a data signal DATA that inhibits the enable flip-flop 15 from being set and enables the mux flip-flop 17 to be set by the next cycle of the third clock delay signal CLK2.

The mux flip-flop 17 then sends a MUX STATE signal to the mux logic circuit 18. The MUX STATE signal controls the state of the mux logic circuit 18 to multiplex the first clock delay signal CLK0 or the second clock delay signal CLK1 that generates a trigger signal TRIGGER.

The enable flip-flop 15 triggered by the trigger signal TRIGGER sets the enable flip-flop 15 thereby setting the enable signal ENABLE that sets the duration of the activation of the piezo alarm element 21. The piezo oscillator circuit 19, activated by the enable signal ENABLE, activates the piezo alarm element to emit an audio alarm signal.

Figure 7:
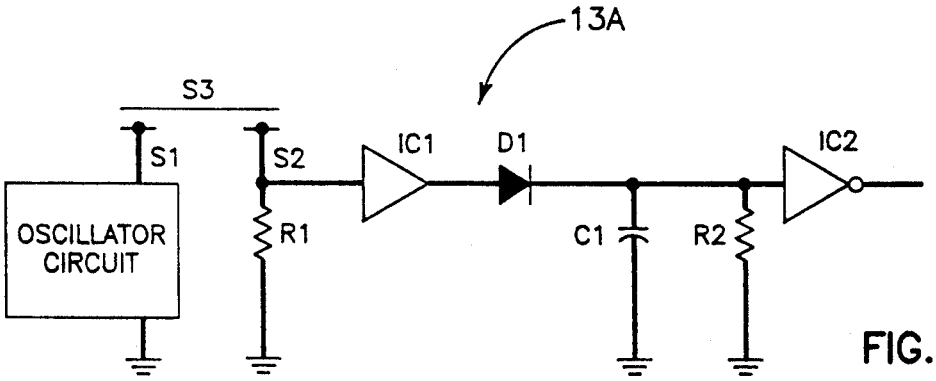
FIG. 7 is a circuit diagram of capacitive reset circuit instead of the resistive reset circuit shown in FIG. 4.

The reset circuit 13 has a resistance-activated switch circuit 22 that has a resistance-activated switch SW1 and a reset logic gate 23. The reset circuit of the alternative embodiment also has a mode switch SW2 to select a delay time interval for the third clock delay signal CLK2. The reset circuit 13 could also be a capacitive circuit 13A as shown in FIG. 7.

Figure 4:
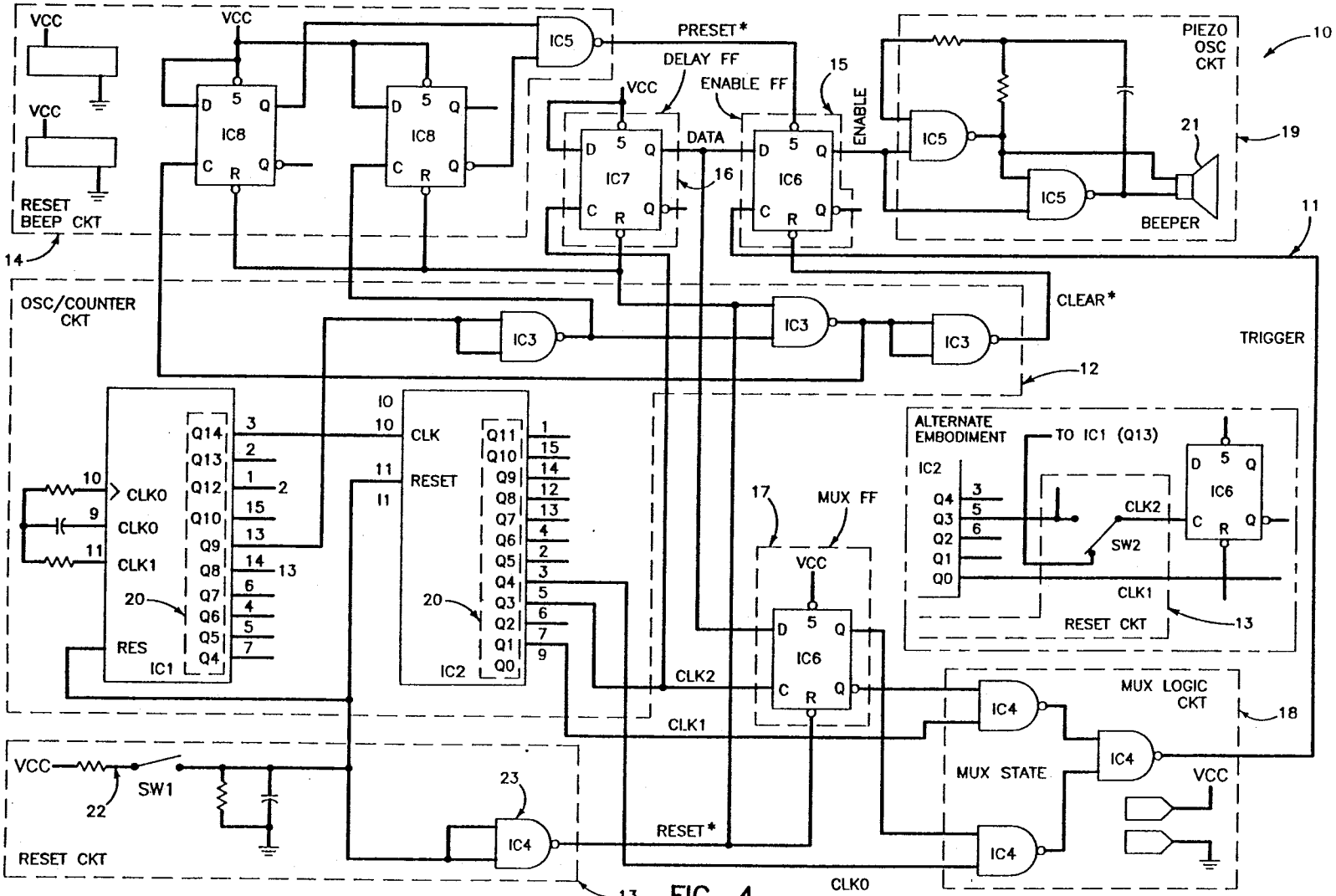
FIG. 4 is circuit diagram of the locating circuit of the locating device.
Figure 5:
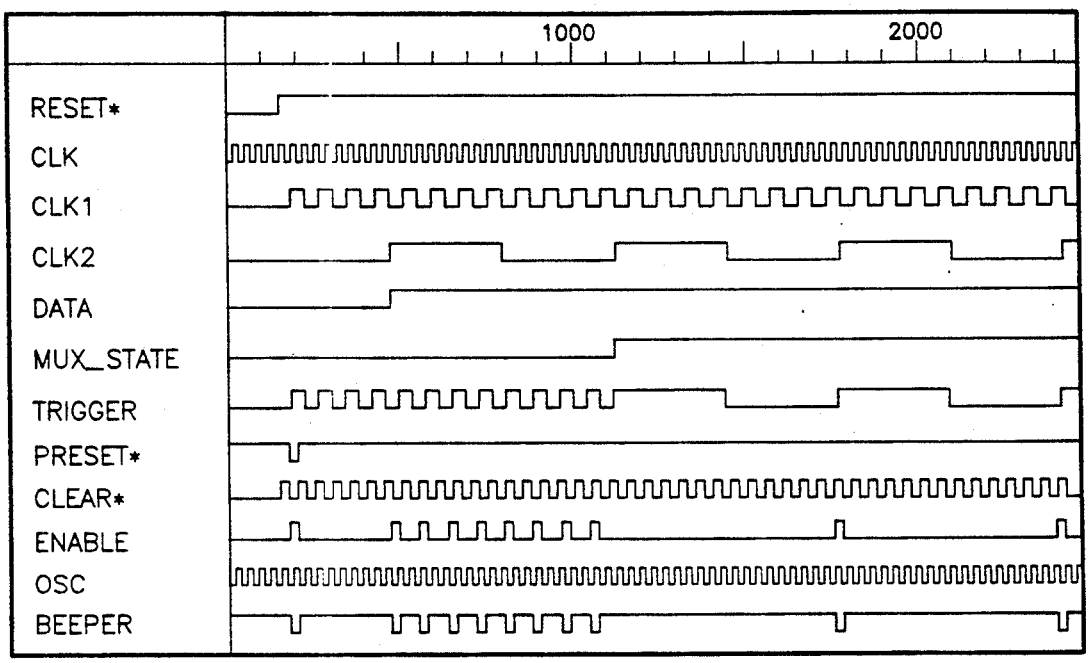
FIG. 5 is a timing diagram of the signal relationship of the preferred embodiment.
Figure 6:
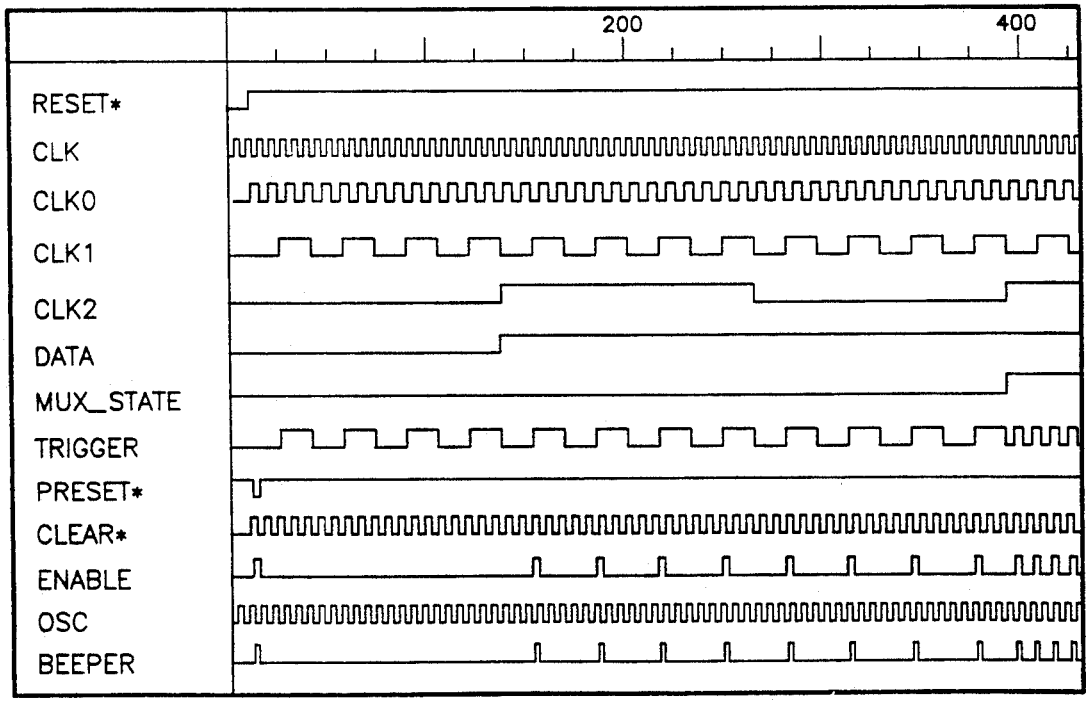
FIG. 6 is a timing diagram of the signal relationship of the alternative embodiment.

Referring to FIG. 4, the operation of the locating circuit 11 of the locating device 10 is explained. The touch switch SW1 enables the counting of all the circuitry. When the contacts are closed, all the circuit's sequential counters 12 (IC1 & IC2), the delay Flip-flop (FF) 16, enable FF 15, mux FF 17, and the reset beep circuit 14 are reset and cleared. When SW1 is open, the RESET* signal is driven high. Then the oscillator/counter 12 starts to generate the master time base signal and the ripple counters 20 begin counting. The counter IC1 outputs a signal Q9 that is used to generate the clear signal CLEAR* (see IC3) that sets the piezo alarm beep signal output time duration. Q9 of IC1 also is used to set both the flip-flops of the reset beep circuit 14 (IC8). These two flip-flops (IC8) generate two sequential latched signals equal to the Q9 signal period time. The two are both logic NAND gated (½IC5) to make a single pulse PRESET* signal. The PRESET* signal overrides the enable FF 15 (½IC6) to cause a single beep output signal. The counter (IC1) Q14 output signal is the input signal to the ripple counter 20 (IC2). The output signal from Q1 of IC2 is the CLK1 signal. CLK1 is the second clock delay signal. The output signal from Q4 of IC2 is the CLK0 signal. CLK0 is the first clock delay signal. The output signal from Q3 of IC2 is the CLK2 signal which is the primary clock signal of the preferred embodiment of the locating circuit 11. CLK2 is the third clock delay signal.

In the alternative embodiment (refer to the inset in FIG. 4), the CLK2 signal may be taken from Q3 or from Q2 by selecting the preferred signal with mode switch SW2. The selected CLK2 signal clocks the delay FF 16 (IC7) which in turn inhibits all the IC6s (enable FF 15 and mux FF 17) from changing state. CLK0 is controlled by IC1 (Q13) instead of IC2 (Q4). The delay FF 16 is cleared during reset by the RESET* signal and is only set once by the CLK2 signal. After the signal DATA is set high, it enables the enable FF and the mux FF 17 to change states with the clock delay signals CLK0, CLK1 and CLK2. The mux FF 17 is cleared during the reset sequence and the MUX STATE signal enables the CLK0 signal to be the TRIGGER output signal. The mux FF 17 controls the sequential clock signals that are used to clock the ENABLE signal.

Figure 2:
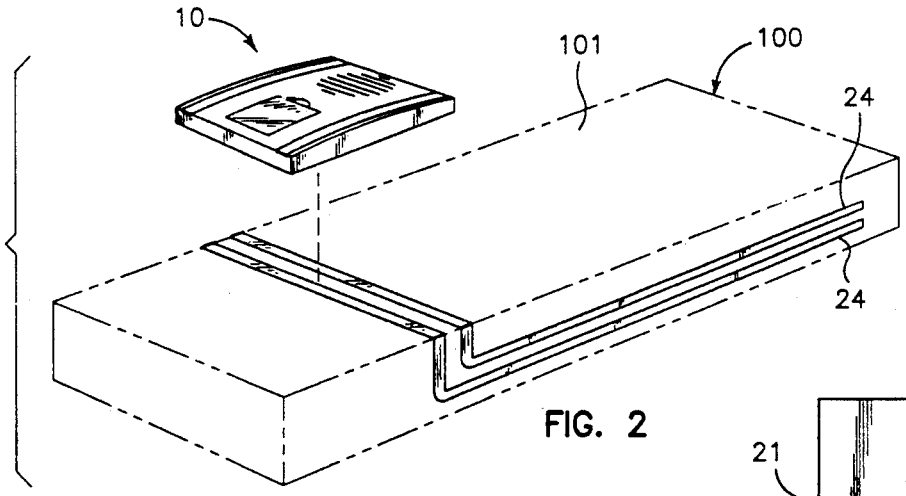
FIG. 2 is an exploded view showing how the locating device could be packaged and placed upon a TV remote control and showing a portion of the reset circuit applied to a surface on the remote control so that by gripping the remote control a user closes the touch switch (SW1).
Figure 8:
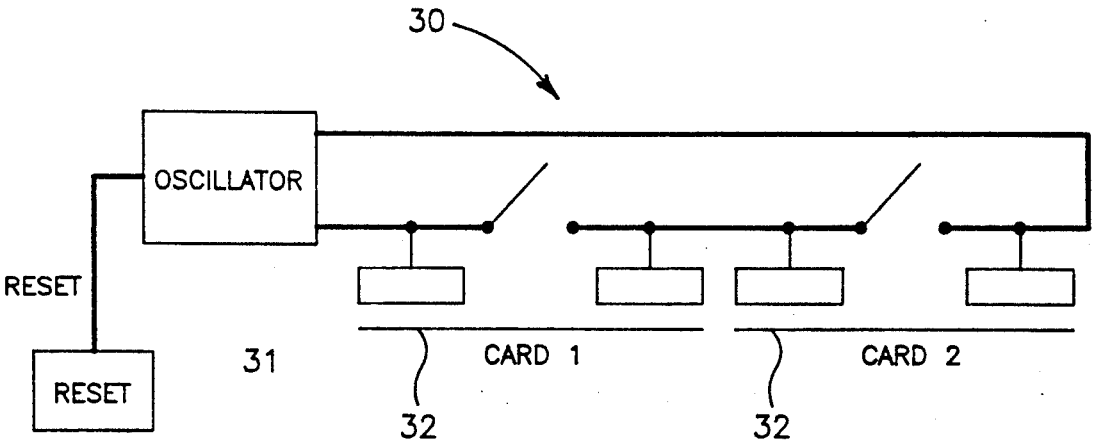
FIG. 8 is a circuit diagram showing the alternative embodiment as used with media cards placed in a base such as a wallet.

FIG. 2 shows an exploded view showing how the locating device 10 could be packaged and placed upon a TV remote control 100. A portion 24 of the reset circuit is applied to a surface 101 on the remote control 100 so that by gripping the remote control 100 a user closes the touch switch (SW1). The locating device 10 could be made quite small using micro-electronic circuitry and placed on a credit card or similar item instead of the remote control. The locating device could be used in combination with an informational media card such as a credit card (See FIG. 8). The circuit 30 would be placed in the base and the conductive strips 31 placed on the cards in an equivalent circuit use. The base to deactivate the locating circuit 10 could then be a carrying case or pouch that could be conductive or have one or more conductive strips 32. When the card is removed from the case the circuit is activated and the audio alarm sounds after a predetermined period of time as described above until the circuit on the card is properly deactivated.

When conductive strip S3 is in close proximity between contacts S1 and S2, the oscillator output at R1 is amplified by IC1 and rectified by D1 to charge C1 and causes the IC2 output RESET* signal to be active. When conductive strip S3 is not present, there is no oscillator circuit output at R1, and C1 discharges through R2 to cause the IC2 output RESET* signal to be active (See FIG. 7).

Figure 3:
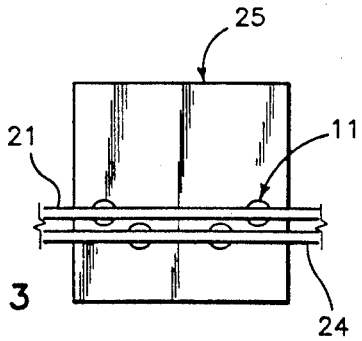
FIG. 3 is a bottom view of the locating device shown in FIG. 2 and showing one method of connecting a portion the reset circuit to a surface of the remote control housing.

FIG. 3 shows a bottom surface 25 of the locating device 10 and showing one method of connecting parts of the reset circuit 13 to a surface of the remote control housing 100.

The foregoing descriptions and drawings are explanatory and illustrative only, and various changes in shape, sizes and arrangements of parts as well certain details of the illustrated construction may be made within the scope of the appended claims without departing from the true spirit of the invention.

I claim:

1. A locating device comprising:

a. a locating circuit comprising a oscillator/counter logic circuit, a reset circuit, a reset beep circuit, an enable flip-flop, a delay flip-flop, a mux (multiplexer) flip-flop and a mux logic circuit and a piezo oscillator circuit;

b. the oscillator/counter logic circuit comprising a plurality of counter flip-flops to generate a first clock delay signal, a second clock delay signal, a third clock delay signal and a clear signal;

c. the reset circuit generating a reset signal to clear the state of the counter flip-flops, in the oscillator/-counter logic circuit, to zero and generate a reset* signal to clear the reset beep circuit, the enable flip-flop, the delay flip-flop, and the mux flip-flop;

d. the reset beep circuit supplying a single pulse, preset signal to the enable flip-flop, the enable flip-flop generating an enable signal that triggers the piezo oscillator circuit to drive a piezo alarm element in the piezo oscillator circuit;

e. the clear signal resets the enable flip-flop to control the duration the piezo alarm element is activated, is driven by the oscillator/counter logic circuit;

f. the delay flip-flop, cleared by the reset* signal and set high by the third clock delay signal, supplies a data signal that inhibits the enable flip-flop from being set and enables the mux flip-flop to be set by the next cycle of the third clock delay signal, g. the mux flip-flop sending a mux state signal to the mux logic circuit;

h. the mux state signal controlling the state of the mux logic circuit to multiplex the first clock delay signal or the second clock delay signal that generates a trigger signal;

i. the enable flip-flop triggered by the trigger signal sets the enable flip-flop setting the enable signal that sets the duration of the activation of the piezo alarm element; and j. the piezo oscillator circuit, activated by the enable signal, activates the piezo alarm element to emit an audio alarm signal.

2. A locating device as described in claim 1 wherein the reset circuit comprises a resistance-activated switch circuit comprising:

a. a resistance-activated switch; and b. a reset logic gate.

3. A locating device as described in claim 2 wherein the reset circuit further comprises a mode switch to select a delay time interval for the third clock delay signal.

4. A locating device as described in claim 2 further comprising a base comprising a conductive circuit to open the resistance-activated switch.

5. A locating device used in combination with an informational media storage card comprising:

a. a locating circuit comprising a oscillator/counter logic circuit, a reset circuit, a reset beep circuit, an enable flip-flop, a delay flip-flop, a mux (multiplexer) flip-flop and a mux logic circuit and a piezo oscillator circuit;

b. the oscillator/counter logic circuit comprising a plurality of counter flip-flops to generate a first clock delay signal, a second clock delay signal, a third clock delay signal and a clear signal;

c. the reset circuit generating a reset signal to clear the state of the counter flip-flops, in the oscillator/-counter logic circuit, to zero and generate a reset* signal to clear the reset beep circuit, the enable flip-flop, the delay flip-flop, and the mux flip-flop;

d. the reset circuit comprising:

a mode switch to select a delay time interval for the third clock delay signal; and a capacitance-activated switch circuit comprising:

a capacitance-activated switch; and a reset logic gate;

e. the reset beep circuit supplying a single pulse, preset signal to the enable flip-flop, the enable flip-flop generating an enable signal that triggers the piezo oscillator circuit to drive a piezo alarm element in the piezo oscillator circuit;

f. the clear signal resets the enable flip-flop to control the duration the piezo alarm element is activated, and is driven by the oscillator/counter logic circuit;

g. the delay flip-flop, cleared by the reset* signal and set high by the third clock delay signal, supplies a data signal that inhibits the enable flip-flop from being set and enables the mux flip-flop to be set by the next cycle of the third clock delay signal, h. the mux flip-flop sending a mux state signal to the mux logic circuit;

i. the mux state signal controlling the state of the mux logic circuit to multiplex the first clock delay signal or the second clock delay signal that generates a trigger signal;

j. the enable flip-flop triggered by the trigger signal sets the enable flip-flop setting the enable signal that sets the duration of the activation of the piezo alarm element; and k. the piezo oscillator circuit, activated by the enable signal, activates the piezo alarm element to emit an audio alarm signal.

6. A locating device as described in claim 5 further comprising a portable base comprising a conductive circuit to open a resistance-activated switch.

* * * * *

UNITED STATES PATENT AND TRADEMARK OFFICE

CERTIFICATE OF CORRECTION

PATENT NO. : 5,204,657

DATED : Apr. 20, 1993

INVENTOR(S) : Robert L. Prosser

It is certified that error appears in the above-indentified patent and that said Letters Patent is hereby corrected as shown below:

On title page, item [19] "Prosser et al" should read --Prosser--

Item [75] "Stephen P. Sacarisen, La Jolla, both of Calif." should read --Calif.--

Signed and Sealed this

Twelfth Day of April, 1994

Bruce Lehman

*Attest:*

BRUCE LEHMAN

*Commissioner of Patents and Trademarks*

*Attesting Officer*